United States Patent [19]

Creissels

[11] 4,026,388

[45] May 31, 1977

[54] INCLINED LIFT

[76] Inventor: Denis C. Creissels, 23, Bld. Marechal Leclerc, 38 Grenoble, France

[22] Filed: May 19, 1976

[21] Appl. No.: 687,865

[30] Foreign Application Priority Data

May 23, 1975 France ..... 75.16255

[52] U.S. Cl. ..... 187/14; 187/12; 187/95

[51] Int. Cl.² ..... B66B 7/02; B66B 5/16

[58] Field of Search ..... 187/12, 13, 14, 10, 187/94, 95, 20

[56] References Cited

UNITED STATES PATENTS

| | | | |
|---|---|---|---|
| 1,702,783 | 2/1929 | Kiesling | 187/95 |
| 2,232,890 | 2/1941 | Stillwagon | 187/13 |
| 3,211,259 | 10/1965 | Tofanelli | 187/95 |
| 3,565,216 | 2/1971 | Gohlke | 187/14 |
| 3,592,294 | 7/1971 | Allen | 187/12 |
| 3,880,258 | 4/1975 | Rompa | 187/94 |

*Primary Examiner*—Evon C. Blunk
*Assistant Examiner*—Jeffrey V. Nase
*Attorney, Agent, or Firm*—Stevens, Davis, Miller & Mosher

[57] ABSTRACT

The invention relates to an inclined elevator having a lift cage secured onto a carriage movable along a track in the form of a track beam mounted on supporting pylons spaced lengthwise the beam. The track beam comprises two spaced girders having each two superposed I sections. The carriage rollers run on the flanges of the I sections.

4 Claims, 2 Drawing Figures

INCLINED LIFT

The invention relates to transportation systems for passengers in which a vehicle secured to a haulage cable travels along an inclined track extending between a downhill and an uphill station. The haulage cable passes over a return pulley in the upper station and is secured to a balance weight travelling in opposite direction along the track. Conventional transportation systems of this kind require massive and costly structures and do not permit an automatic control similar to an elevator control with push buttons actuated by the passengers.

The object of the present invention is to overcome the aforementioned disadvantages and to provide a transportation system in which the control can be achieved by conventional lift control techniques.

Another object of the invention is to provide a transportation system build up with conventional parts of vertical lifts such as the lift cage, the balance weight, the drive and control unit and so like.

According to the invention, a vehicle having a passengers compartment, conveniently termed a lift cage, is supported upon and driven along a rail in the form of a straight beam mounted on supporting pylons, spaced lengthwise of the beam.

It is another object of the invention to provide a track beam supporting the vehicle and the counterweight which travel in opposite direction along the track beam.

Another object of the invention is to provide a track beam formed of a steel frame construction with conventional I sections so that under severe snow conditions, snow or ice does not rest on the top surface of the beam or on the track.

Other advantages and features of the invention will become evident more clearly from the following description of a mode of application of the invention, given as a non-restrictive example and represented in the attached drawings, in which.

Figure 1:
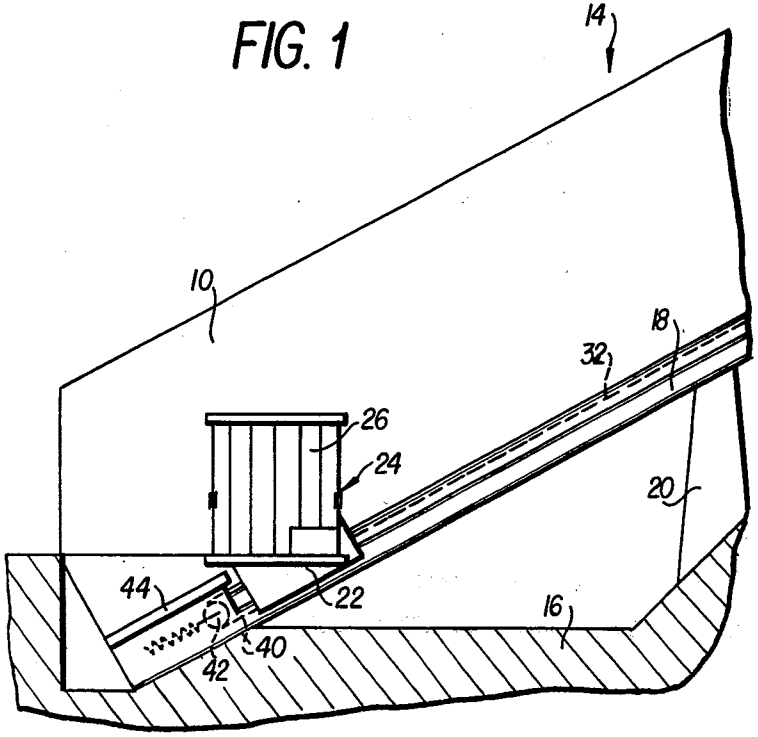
FIG. 1 is a schematic elevation, partly in section of the transportation system according to the invention.

Referring first to FIG. 1 which shows the general exterior arrangement of the transportation system, it will be seen that an inclined lift 14 extends between a lower station 10 and an upper station 12 located on the slope of a mountain 16. A straight track beam 18 is mounted on supporting pylons 20 spaced lengthwise of the beam between the two stations 10, 12. A carriage 22 supporting a passengers compartment, named lift cage 24, travels to and fro along the track beam 18. The lift cage 24 has an horizontal floor and two side doors, only one 26 being shown in FIG. 1. The station platforms 28 have doors 30 which open automatically together with the lift cage door 26 as the lift stops in the station. The doors 24, 30 and the control device for the doors are conventional lift doors and control techniques.

The lift cage carriage 22 is attached to a haulage cable 32, more particularly to a plurality of parallel cables passing over a return pulley 34, and a carriage 36 carrying a counterweight 38 is attached to the other end of the haulage cable 32. A drive motor (not shown) is installed in a machine room 41 of the upper station 12 and is arranged to rotate the return pulley 34 and to drive the carriage 22, 36 in opposite directions along the track beam 18.

A control cable 40 and a safety cable passing over return sheaves 42, are secured to the carriages 22, 36 and are arranged to control the lift cage stopping in the stations and a safety clamp device. The drive unit and these control and safety devices are of the kind used in conventional lifts and it is unnecessary to describe their structure or functioning. Shock absorbers 44 limit the travel of carriages 22, 36 on the ends of the track.

Figure 2:
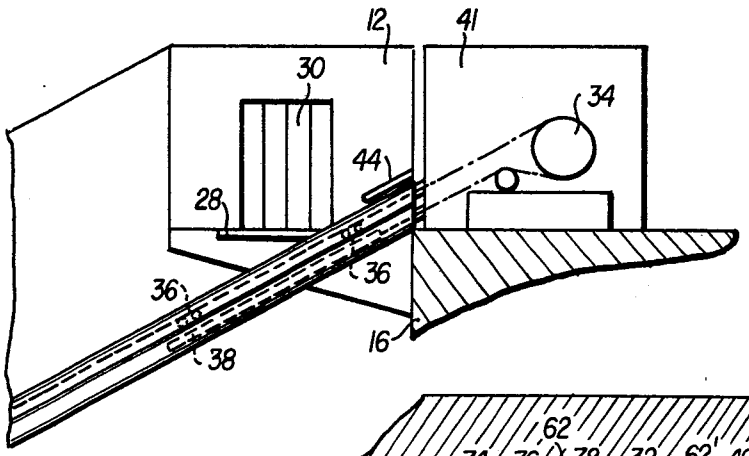
FIG. 2 is an enlarged traverse section through the track beam shown in FIG. 1.
Figure 2:
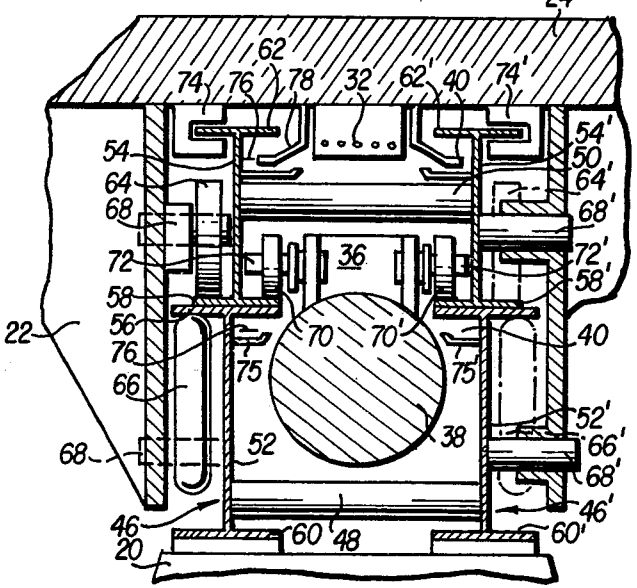

Referring now to FIG. 2, it will be seen that the track beam 18 has a steel framework comprising two spaced girders 46, 46' braced by means of bracing girders 48, 50. The two girders 46, 46' are identical and each has two superposed I sections 52, 54; 52', 54' with flanges 56, 58; 56', 58', jointed together. The lattice steel structure provides high resistance to the force of flexure or torsion and the supporting pylons 20 are spaced about 10 meters. The bottom flanges 60, 60' of the I sections 52, 52' rest on the top of the pylons 20 and the top flanges 62, 62' of the I sections 54, 54' cover each girder 46, 46'.

The lift cage 24 travels over the track beam 18 and its carriage 22 is provided with freely rotatable support rollers 64, 64', of which only one pair is shown in FIG. 2, the treads of which act in conjunction with the jointed outside flanges 56, 58; 56', 58' which form two runways. Pneumatic tired counter-rollers 66, 66' are engaged against the under surface of said jointed outside flanges 56, 58; 56', 58' to maintain the carriage 22 onto the track. The carriage 22 is stabilized with respect to the track beam 18 by means of guide rollers 68, 68' engaging the side surfaces of the track beam 18 formed by the webs of the I sections 52, 52', 54, 54'.

The counterweight carriage 36 travels inside the track beam 18 and its support rollers 70, 70' run upon the jointed inside flanges 56, 58; 56', 58'. Guide rollers 72, 72' engage the inside surface of the I section webs 54, 54'. Carriage 22 is equipped with safety devices 74, 74' having brake shoes which engage in a locked position the flanges 62, 62' of the I sections 54, 54' to prevent movement of the carriage relative to the track beam 18.

The haulage cable(s) extends above the bracing girders 50 and is supported by the latter. One strand of the control cable 40 extends underneath the flange 62' and the other strand underneath flange 56'. The I sections are provided with control cable support fingers 75' and in a similar manner the safety cable 76 extends underneath the flanges 62 and 56 and above support fingers 75 and is secured to a brake control lever 78 of carriage 22.

It will be clear that the above described transportation system may include the conventional lift components and that the track beam 18 comprises conventional I sections. The jointed flanges form suitable runways for the carriage support rollers and all the cables extend inside the track beam.

What is claimed is:

1. A transportation system comprising a first carriage having freely rotatable support rollers, a passenger compartment carried by said first carriage, a second carriage having freely rotatable support rollers, a counterweight secured to said second carriage, a straight track beam comprising two spaced girders each girder comprising two superposed I sections having webs extending substantially in a vertical plane and side flanges arranged on the opposite sides of the webs to form runways for said first and second carriages, running on the superposed flanges of said I sections, a downhill and an uphill station, said track beam being inclined and extending between said stations, supporting pylons spaced lengthwise to support said track beam, a carriage haulage device comprising a motor driven return pulley located in one of said stations and a haulage cable passing over said return pulley and having opposite ends each secured to one of said carriages, said runways being arranged to permit running in opposite directions and crossing of said carriage along said track beam.

2. A transportation system according to claim 1, comprising a safety braking device secured to said first carriage and having brake shoes which engage in braking position a flange of said I sections and a safety brake cable extending between said first and second carriage.

3. A transportation system according to claim 2, comprising a control cable arranged to control the stopping of said first carriage in the stations and extending between said first and second carriages, said haulage cable, safety brake cable and control cable extending inside the track beam.

4. A transportation system comprising an uphill and a downhill station, a straight inclined track beam extending between said stations, supporting pylons spaced lengthwise to support said track beam, a first carriage having freely rotatable support rollers and guide rollers, a passenger compartment carried by said first carriage and having at least an access door, a second carriage having freely rotatable support rollers and guide rollers, a counterweight secured to said second carriage, said track beam comprising two I shaped girders extending parallely and having vertical webs and side flanges arranged on the opposite sides of each web to form runways for said first and second carriages, said second carriage running insides the track beam between said two girders, its support rollers running on the inside flanges of the I shaped girders and its guide rollers running on said webs and said first carriage straddling said track beam, its support rollers running on the outside flanges of the I shaped girders and its guide rollers running on said webs, a carriage haulage device comprising a motor driven return pulley located in one of said stations and a haulage cable passing over said return pulley and having opposite ends each secured to one of said carriages for moving the carriages up and down the inclined track, one carriage being positioned in the uphill station when the other is positioned in the downhill station and brake means secured to said first carriage having brake shoes which engage in braking position a flange of said I shaped girders.

* * * * *